US008535030B2

(12) United States Patent
Chua

(10) Patent No.: US 8,535,030 B2
(45) Date of Patent: Sep. 17, 2013

(54) GEROTOR HYDRAULIC PUMP WITH FLUID ACTUATED VANES

(76) Inventor: Kelly Hee Yu Chua, Saginaw, MI (US)

( * ) Notice: Subject to any disclaimer, the term of this patent is extended or adjusted under 35 U.S.C. 154(b) by 409 days.

(21) Appl. No.: 12/927,443

(22) Filed: Nov. 15, 2010

(65) Prior Publication Data

US 2011/0200477 A1 Aug. 18, 2011

Related U.S. Application Data

(60) Provisional application No. 61/305,211, filed on Feb. 17, 2010.

(51) Int. Cl.

| | |
|---|---|
| ***F01C 1/10*** | (2006.01) |
| ***F01C 19/02*** | (2006.01) |
| ***F03C 2/02*** | (2006.01) |
| ***F04C 18/10*** | (2006.01) |
| ***F04C 27/00*** | (2006.01) |

(52) U.S. Cl.
USPC ..... 418/171; 418/136; 418/162; 418/268

(58) Field of Classification Search
USPC ..... 418/171, 61.3, 64, 65, 162, 268, 418/136
See application file for complete search history.

(56) References Cited

U.S. PATENT DOCUMENTS

| | | | | |
|---|---|---|---|---|
| 2,866,417 | A * | 12/1958 | Nubling | 418/171 |
| 3,429,269 | A * | 2/1969 | Walter | 418/171 |
| 3,619,089 | A * | 11/1971 | Pierrat | 418/171 |

* cited by examiner

*Primary Examiner* — Mary A Davis
(74) *Attorney, Agent, or Firm* — William C. Lin, PLC

(57) ABSTRACT

A gerotor pump having an outer rotor defining an inner surface of the outer rotor, a thrust plate, a pressure plate, an inlet chamber for fluid intake through the thrust plate to be pressurized, and an outlet chamber for outputting pressurized fluid from the pressure plate. The gerotor pump includes an inner rotor assembly in rotating engagement with the outer rotor. The inner rotor assembly rotating about an axis, the inner rotor assembly comprises a rotor body, wherein the rotor body includes N (an integer greater than one) vane slots defining a first sealing surface, and the rotor body includes N inner openings around the axis, each of the inner opening adjoining a vane slot; and a plurality of vanes defining a second sealing surface, wherein the vane is disposed in the vane slot and in sealing engagement with the rotor body via the first and second sealing surfaces. The inner rotor assembly is in sealing engagement with the outer rotor by the vane engaging on the inner surface of the outer rotor.

12 Claims, 9 Drawing Sheets

GEROTOR HYDRAULIC PUMP WITH FLUID ACTUATED VANES

CROSS-REFERENCE TO RELATED APPLICATIONS

This application claims the benefit of Provisional Application No. 61/305,211, filed on Jan. 26, 2010. The disclosure of the above application is incorporated herein by reference.

FIELD

The present invention relates to gerotor type hydraulic pump; and more particularly to an inner rotor assembly with improved volumetric efficiency.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Gerotor pumps have wide range of application. These devices are used as compressor for air conditioner, hydraulic motor to drive mechanical systems, pump to deliver oil to lubricate the internal components in motion of the engine, pump in the automatic transmission to provide hydraulic power to actuate the clutch or dual clutch systems, just to name a few. However, pursuit to increase volumetric efficiency of gerotor pumps as well as to prevent or mitigate galling and gauging of pump components during operation has never come to an end.

Gerotor pump includes a housing member, an outer rotor and an inner rotor operatively engaged to form a rotor set disposed within the housing member. A thrust plate and a pressure plate within the housing member define an axial space where the rotor set is enclosed and driven by an input shaft. During operation, teeth of the inner rotor travel over a conjugate inner surface of the outer rotor to form expanding volume chambers for fluid intake, and contracting volume chamber for providing pressurized fluid output. A clearance between the inner rotor and the outer rotor is necessary to allow the inner rotor to rotate within the outer rotor; however, fluid leakage may also result due to the clearance and result in a lower volumetric efficiency. Pressure capability may also be reduced as the clearance between inner and outer rotor grows arising out of normal wear and tear but without means of compensation.

The rotor set rotates inside the space defined by the thrust plate and the pressure plate. It is desirable that axial ends of the outer rotor and inner rotor make tight sealing engagement with adjacent axial end surfaces of the thrust plate and pressure plate to avoid fluid leakage. A tight sealing engagement, however, may result in undesirable galling and gauging of the rotors and the plates, resulting in device damage. Fluid may be pumped to the mechanical clearances between the rotor set and the thrust and pressure plates to provide lubrication to prevent the galling and gauging of component.

SUMMARY

In one feature, the disclosure describes a gerotor pump. The gerotor pump has an outer rotor, a thrust plate, a pressure plate, an inlet chamber for fluid intake through the thrust plate to be pressurized, and an outlet chamber for outputting pressurized fluid from the pressure plate. The outer rotor defines an inner surface of the outer rotor. The gerotor pump includes an inner rotor assembly in rotating engagement with the outer rotor. The inner rotor assembly rotates about an axis. The inner rotor assembly includes a rotor body and a plurality of vanes. The rotor body includes N (an integer greater than one) vane slots and N of inner openings around the axis. Each inner opening adjoins with a vane slot. The vane slot defines a first sealing surface. The vane defines a second sealing surface. The vane is disposed in the vane slot. The vane is sealing engagement with the rotor body via the first and second sealing surfaces. The inner rotor assembly is in sealing engagement with the outer rotor by the vane engaging on the inner surface of the outer rotor.

In another feature, the disclosure describes another gerotor pump. The gerotor pump has an outer rotor, a thrust plate, a pressure plate, an inlet chamber for fluid intake through the thrust plate to be pressurized, and an outlet chamber for outputting pressurized fluid from the pressure plate. The gerotor pump includes an inner rotor assembly. The inner rotor assembly is in rotating engagement with the outer rotor. The inner rotor assembly rotates about an axis. The inner rotor assembly includes a rotor body and a plurality of vane assemblies. The rotor body has a plurality of vane slots and a plurality of inner openings. The vane assembly is disposed in the vane slot. The vane assembly includes a vane head and a vane seat. The vane seat has a trough to receive the vane head. The vane head and the vane seat are in sealing engagement in the trough. The inner rotor assembly is in sealing engagement with the outer rotor by the vane head engaging on the inner surface of the outer rotor.

In other features, the disclosure describes a gerotor pump. The gerotor pump has a thrust plate, a pressure plate, an inlet chamber for fluid intake through the thrust plate to be pressurized, and an outlet chamber for outputting pressurized fluid from the pressure plate. The gerotor pump includes an outer rotor rotating about a first axis. The gerotor pump includes an inner rotor rotating about a second axis. The second axis is parallel with the first axis. The inner rotor defines a plurality of rotor openings around the second axis, and the inner rotor is in rotating engagement with the outer rotor. The inner and outer rotors are disposed between, and in sealing engagement with a first axial end surface of the thrust plate and a second axial end surface of the pressure plate. The thrust plate defines a first annular groove on the first axial end surface, and the pressure plate defines a second annular groove on the second axial end surface. The second annular groove has a plurality of fluid communication holes. The fluid communication holes are in fluid communication with the first annular groove, the second annular groove and the rotor openings. The radius of any of the first and second annular grooves is comparable to a distance between the rotor openings and the second axis.

Advantageously, the present invention uses vanes to replace external teeth of the inner rotor of a gerotor pump, utilizing centrifugal force and outlet port fluid pressure and/or mechanical spring to force the vanes slightly in outward direction radially for a tight sealing engagement against the conjugate surface of the outer rotor internal teeth (lobes) thus providing high volumetric efficiency and high output pressure capability.

Advantageously, the present invention provides continuous lubrication to clearances between the rotor set and the plates adjacent thereto via annular groove and fluid communication holes in the pressure plate, annular groove in the thrust plate and inner opening in the inner rotor.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
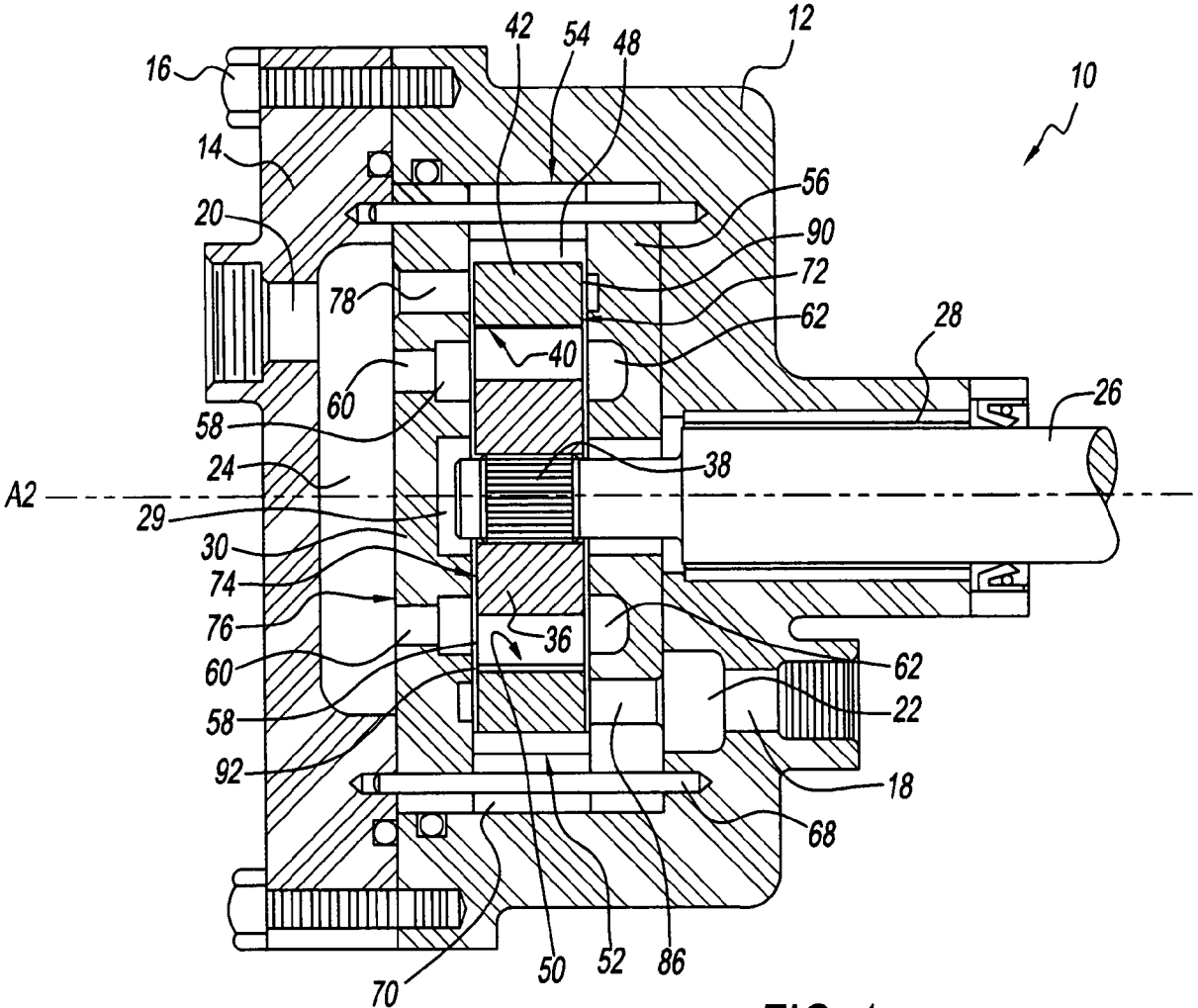
FIG. 1 shows an axial cross sectional view of a hydraulic pump or compressor according to the principles of the present invention.

The following description is merely exemplary in nature and is in no way intended to limit the disclosure, its application, or uses. For purposes of clarity, the same reference numbers with or without a single or multiple prime symbols appended thereto will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure unless otherwise specified.

A gerotor pump in accordance with the disclosure provides hydraulic power to mechanical actuation systems. The gerotor pump includes a drive shaft that engages an inner rotor. The inner rotor is disposed in the outer rotor, and the inner and outer rotor jointly form a rotor set. The inner rotor may be an inner rotor assembly that includes vane members performing as teeth of the inner rotor. The outer rotor defines lobes (teeth), whereby rotation of the inner and outer rotors defines an expanding volume chamber in fluid communication with a fluid inlet port of the gerotor pump, and a contracting volume chamber in fluid communication with the fluid outlet port.

Referring now FIG. 1, an axial cross sectional view of a hydraulic gerotor pump or compressor 10 is shown. The gerotor pump or compressor 10 may include a housing member 12 and an end cap 14. The housing member 12 and the end cap 14 are held together in tight sealing engagement by means of a plurality of bolts 16. The housing member 12 defines a fluid inlet port 18 and a fluid outlet port 20. The inlet port 18 opens into an inlet chamber 22, while the outlet port 20 is open to, and in fluid communication with an outlet chamber 24. The gerotor pump 10 may include a input (drive) shaft 26 that extends through an opening in a journal bearing 28 for receiving and rotatably supporting the input shaft 26. The input shaft 26 extends axially almost to the bottom of the center pocket 29 of a pressure plate 30. The journal bearing 28 may be replaced by a typical ball bearing or a needle bearing.

Figure 2:
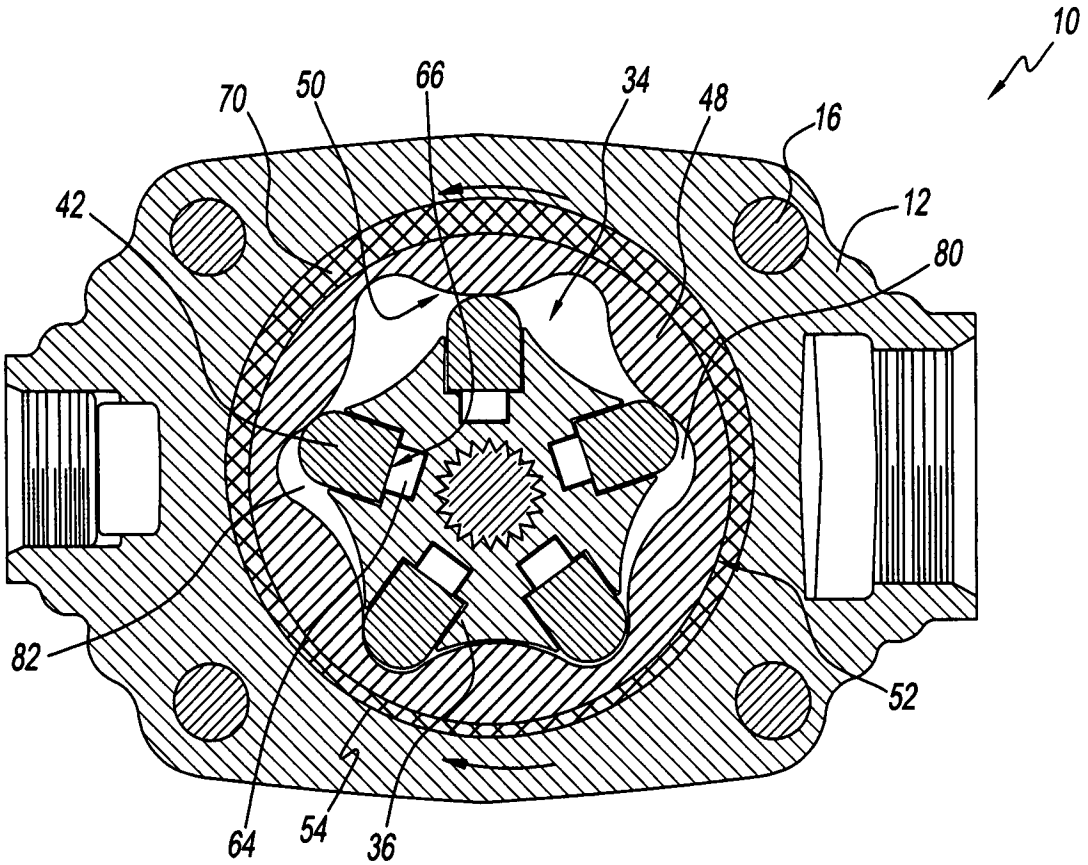
FIG. 2 shows another cross sectional view of a hydraulic pump or compressor according to the principles of the present invention.

Referring now also to FIG. 2, in conjunction with FIG. 1, a cross sectional view of the gerotor pump 10 looking from line $L_1$-$L_1$' is shown. The input shaft 26 extends through a thrust plate 56, and is in driving engagement with a pumping element or fluid displacement mechanism, generally designated 32. In the subject embodiment, the fluid displacement mechanism 32 may include a gerotor of the internally generated rotor (IGR) type. The IGR type gerotor may include an inner rotor assembly 34. The inner rotor assembly 34 may include a rotor body 36 and a plurality of vanes 42 disposed in the rotor body 36 to define teeth of the inner rotor assembly 34. The rotor body 36 defines about it's inside diameter a plurality of serrations 38. The rotor body 36, and therefore the inner rotor 34, is in driven engagement with the input shaft 26 by means of the serrations 38.

The gerotor pump 10 also includes an outer rotor 48. The outer rotor 48 defines an axis of rotation A1 (illustrated in FIG. 8) about which it rotates. The the inner rotor assembly 34 defines an axis of rotation A2 (also illustrated in FIG. 8), about which it rotates. The pumping element or fluid displacement mechanism 32 in the subject embodiment may be of the "fixed axis" type, wherein both of the axes of rotation A1 and A2 remain fixed or stationary, and neither axis orbits about the other axis, as occurs in orbiting gerotor type devices.

Figure 3B:
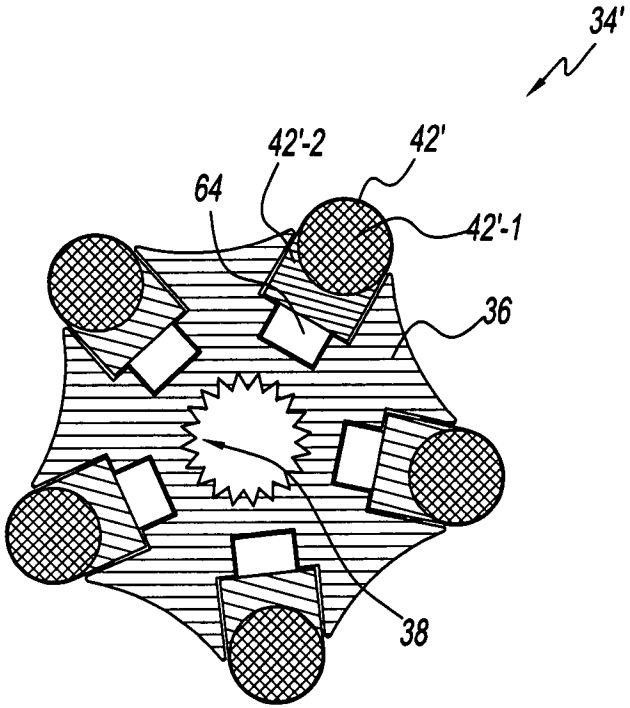
FIG. 3 shows cross sectional views of two inner rotor assemblies according to the principles of the present invention.
Figure 3A:
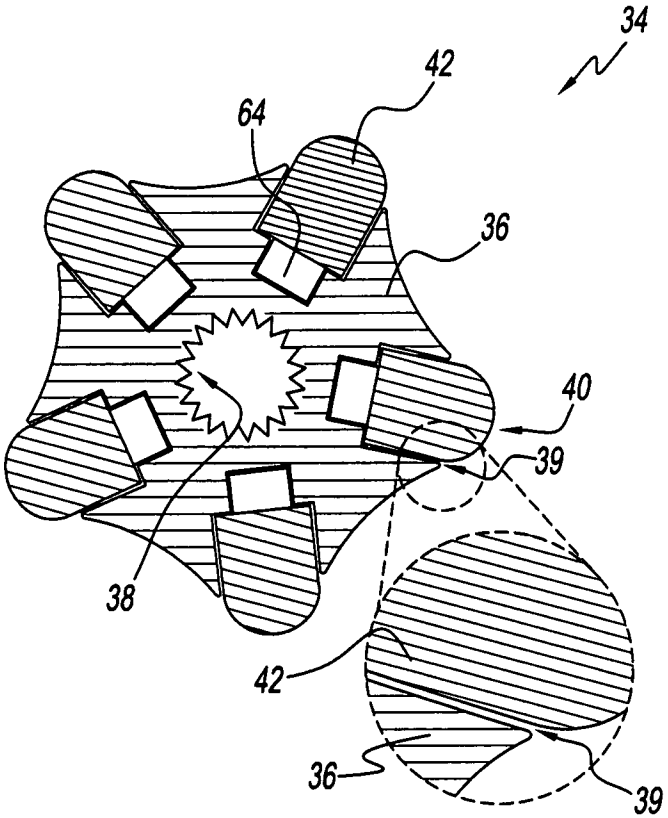

Referring also to FIG. 3, a cross sectional view of the inner rotor assembly 34 is shown in FIG. 3(A) and a cross sectional view of another inner rotor assembly 34' is shown in FIG. 3(B). As illustrated in FIG. 3(A), the inner rotor assembly 34 includes the rotor body 36 and a plurality of the vanes 42 disposed in the rotor body 36 so that the vanes 42 operate as teeth of the inner rotor assembly 34 of the gerotor pump 10. The vane 42 is disposed in the vane slot 40 in radial direction, and each vane 42 is in sealing engagement with the rotor body 36 when disposed in the rotor body 36 (explained in FIGS. 4 and 5). A bottom side of the vane 42 may be exposed to an inner opening (cavity) 64 that is adjoining and below the vane slot 40 when the vane 42 is disposed in the vane slot 40. Hydraulic fluid pressure may be present in the inner opening 64 to force the vane 42 slightly in outward direction radially for a tight sealing engagement for improved pump volumetric efficiency. Mechanical spring may also be placed inside the inner opening 64 to exert radially outward force upon the vane 42.

Figure 4:
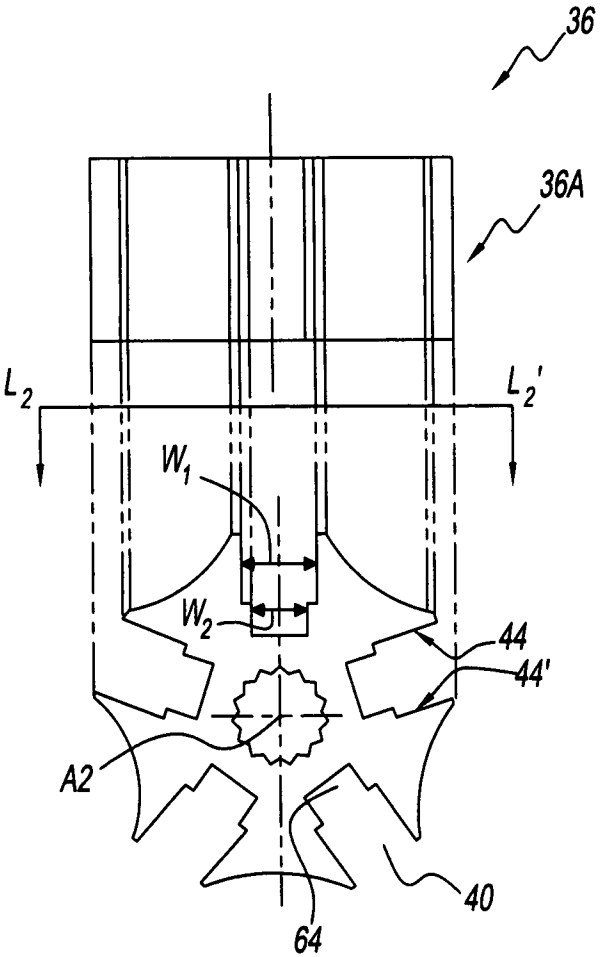
FIG. 4 shows cross sectional views of an inner rotor body according to the principles of the present invention.

Referring also to FIG. 4, cross sectional views of the rotor body 36 is shown. The cross sectional view 36A is a view looking from line $L_2$-$L_2$' at the rotor body 36. The rotor body 36 may define five (or N, where N is an integer) vane slots 40. The vane slots 40 may be generally stepped rectangular slots. The vanes 42 are disposed within each of the vane slots 40.

The vane slot 40 has a pair of sealing surfaces 44 and 44'. The vane 42 may be in contact with the vane slot 40 at the sealing surfaces 44 and 44' when disposed therein, and may make sealing engagement with the rotor body 36 at the vane slot 40 via the sealing surfaces 44 and 44'.

The rotor body 36 may also define a plurality of inner openings 64 between the vane slots 40 and the rotating axis A2 that the rotor body 36 rotates about. The vane slot 40 and the inner opening 64 are open to, and adjoining each other; and the inner opening 64 is further inside into the rotor body 36 from the vane slot 40. In one embodiment as depicted in FIG. 4 the inner openings 64 is stepped rectangular slots. The width $W_2$ of the inner opening 64 is sufficiently smaller than the width $W_1$ of the vane slot 40 to prevent the vane 42 from sliding into the inner opening 64. In other embodiments the inner opening 64 may be wider than the vane slot 40 or of the same width. Mechanical spring (not shown) may also be placed in the inner opening 64 to exert force upon the vane 42 radially outward.

Figure 5:
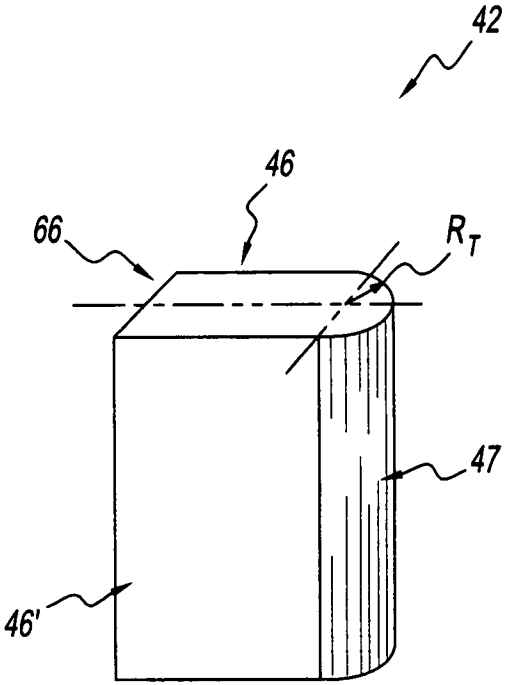
FIG. 5 shows an isometric view of a vane member according to the principles of the present invention.

Referring also to FIG. 5, an isometric view of the vane 42 is shown. The vane 42 defines a pair of sealing surfaces 46 and 46' and a bottom surface 66. The sealing surface 46 of the vane 42 may be in contact with the sealing surface 44 of the vane slot 40 when the vane 42 is disposed in the vane slot 40. Those skilled in the art of gerotor pump can appreciate that thin film of fluid may fill a slight clearance between the sealing surfaces 42 and 44 to make sealing engagement between the vane 42 and the rotor body 36 at the vane slot 40. The bottom surface 66 of the vane 42 is exposed to the inner opening 64 when the vane 42 is disposed in the vane slot 40. The vane 42 may have a convex top surface 47 so the convex top surface 47 operates like the lobe (tooth) for the inner rotor assembly 34. The top surface 47 may be characterized by a radius $R_T$. The bottom surface 66 may have a flat surface with straight edges.

Figure 10:
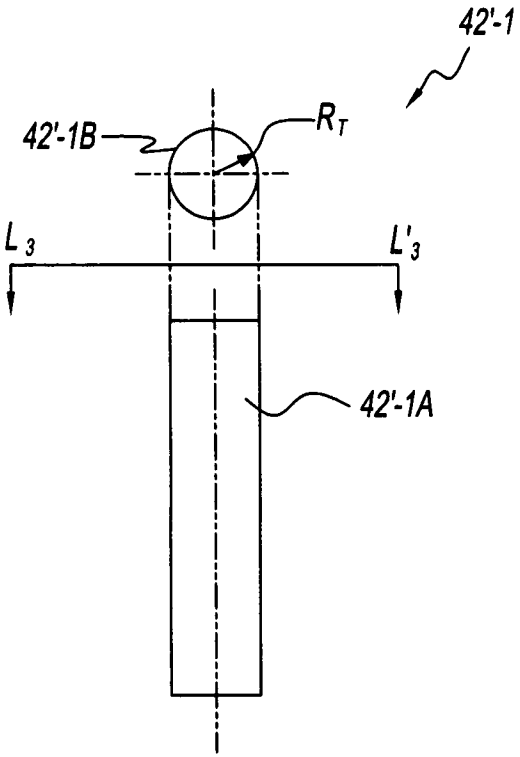
FIG. 10 shows cross sectional views of a vane head according to the principles of the present invention.
Figure 9:
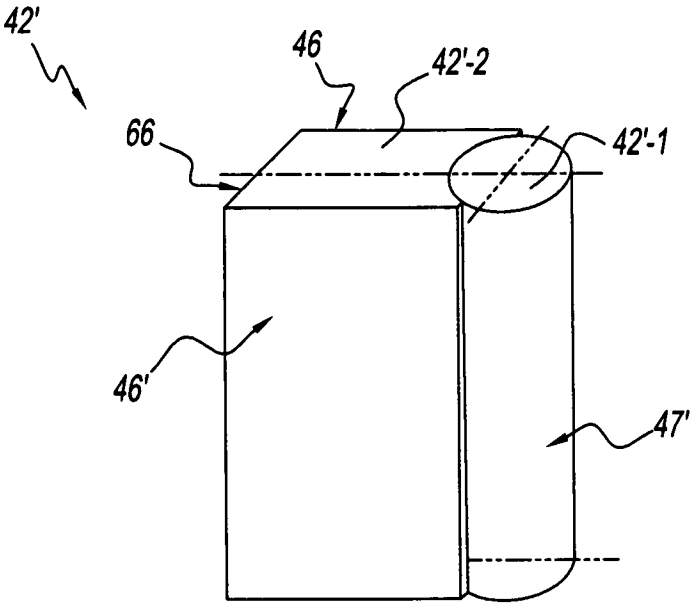
FIG. 9 shows an isometric view of a vane assembly according to the principles of the present invention.
Figure 11:
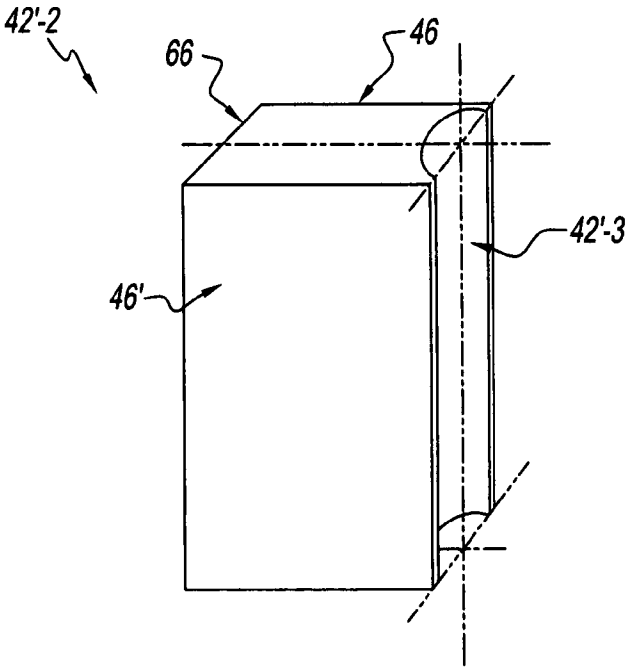
FIG. 11 shows an isometric view of a vane seat according to the principles of the present invention.

Referring now to FIG. 3, in one embodiment, the vane 42 of the inner rotor assembly 34 in FIG. 3(A) may be replaced by a vane assembly 42' shown in FIG. 3(B). Referring now also to FIG. 9, an isometric view of the vane assembly 42' is shown. The vane assembly 42' may be used in lieu of the vane 42 in a gerotor pump according to the principles of this disclosure. The vane assembly comprises a vane head 42'-1 and a vane seat 42'-2. The vane head 42'-1 provides a convex surface 47' similar to the convex top surface 47 of the vane 42. The vane head 42'-1 may be a cylindrical roller with radius $R_T$ as illustrated in FIG. 10. FIG. 10 shows cross sectional views of the vane head 42'-1. A cross sectional view 42'-1A viewed from the top of the vane head 42'-1 and a cross sectional view 42'-1B viewed from the side of the vane head 42'-1 are shown. When the inner rotor and the outer rotor are in rotating engagement, the vane head 42'-1 is in sealing engagement with the inner surface 50 of the outer rotor 48. The cylindrical roller serves as a bearing between the outer rotor 48 and the vane seat 42'-2. FIG. 11 shows an isometric view of the vane seat 42'-2. The vane seat 42'-2 includes a trough 42'-3 to receive the vane head 42'-1.

The vane seat 42'-2 defines a pair of sealing surfaces 46 and 46' and a bottom surface 66. The sealing surface 46 of the vane seat 42'-2 may be in contact with the sealing surface 44 of the vane slot 40 when the vane seat 42'-2 is disposed in the vane slot 40. Those skilled in the art of gerotor pump can appreciate that thin film of fluid may fill a slight clearance between the sealing surfaces 42 and 44 to make sealing engagement between the vane seat 42'-2 and the rotor body 36 at the vane slot 40. The bottom surface 66 of the vane seat 42'-2 is exposed to the inner opening 64 when the vane seat 42'-2 is disposed in the vane slot 40.

Figure 12:
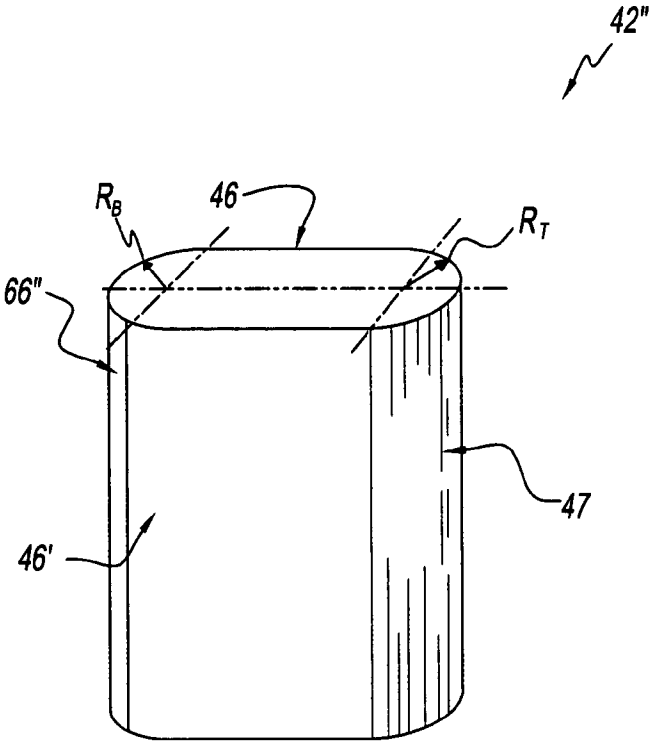
FIG. 12 shows an isometric view of another vane member according to the principles of the present invention.

Referring now to FIG. 12, an isometric view of another vane 42" is shown. The vane 42" may be used in lieu of the vane 42 in a gerotor pump 10 according to the principles of this disclosure. By comparing the vane 42 and vane 42" the difference therebetween can be appreciated. The vane 42" has a convex bottom surface 66" while the vane 42 has a flat bottom surface 66. The convex bottom surface 66" may be characterized by a radius $R_B$ which may be the same as, or different from a radius $R_T$ that characterizes the convex top surface 47 of the vane 42".

Figure 14:
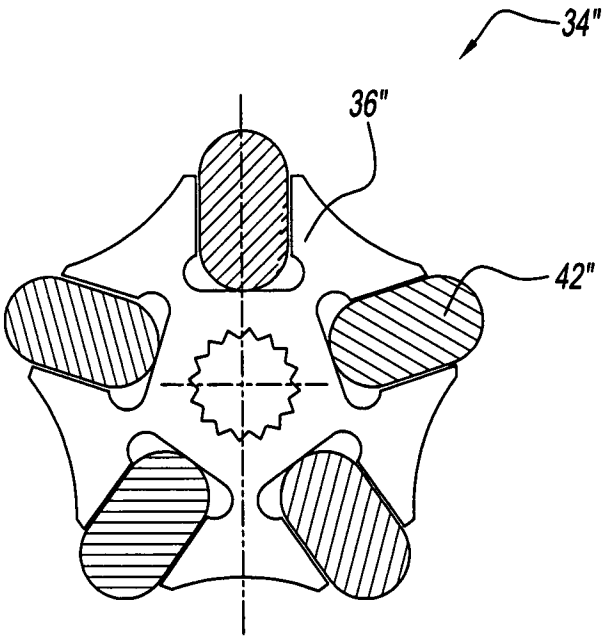
FIG. 14 shows a cross sectional view of another inner rotor assembly according to the principles of the present invention.
Figure 13:
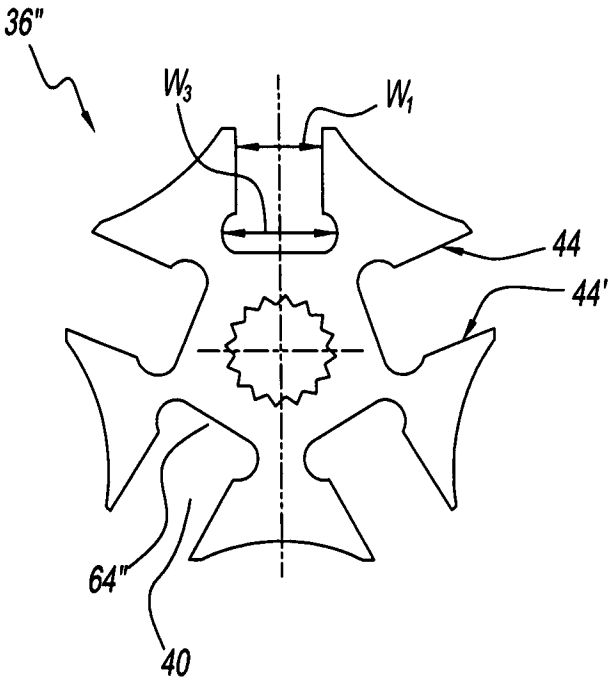
FIG. 13 shows cross sectional views of another inner rotor body according to the principles of the present invention.

In one embodiment, the vane 42" may be used in the rotor body 36 depicted in FIG. 4. In another embodiment, the vane 42" may be used in another rotor body 36" depicted in FIG. 13. The rotor body 36" defines an inner opening 64" and the vane slot 40 where the width $W_3$ of the inner opening 64" is larger than the width $W_1$ of the vane slot 40. The inner opening 64" may have an oval shape in general. The inner opening 64" may also have a shape other than oval, for example, rectangular (not shown). FIG. 14 illustrates an inner rotor assembly 34" comprising the rotor body 36" and the vane 42".

Referring now also to FIG. 3(A), a slight clearance 39 between the vane 42 and the inner rotor vane slot 40 (substantially occupied by the vane 42 in the drawing) allows the vane 42 to move slightly in radial direction either inward or outward. Pressurized fluid in the inner opening 64 in fluid communication with the outlet port 20 pressurizes the bottom surface 66 of the vane 42 and forces the vane 42 in radial (outward) direction. The centrifugal force exerted on the vane 42 combines with the fluid pressure on the bottom surface 66 causes the vane 42 to seal tightly against the conjugate inner surface 50 of the outer rotor 48, thus providing for improved volumetric efficiency and higher output pressure.

Referring now to FIGS. 1 and 2, the housing member 12 defines a cylindrical opening 54. An eccentric ring 70 is disposed within the cylindrical opening 54. The outer rotor 48 is journalled within a cylindrical opening of the eccentric ring 70, which is in contact with, and also defines a cylindrical outside surface 52 of the outer rotor. The inner rotor assembly 34 is eccentrically disposed within an outer rotor 48, and is in contact with the outer rotor 48 at the inner surface 50 of the outer rotor 48.

The eccentric ring 70 stacks between the thrust plate 56 and the pressure plate 30, defines a cylindrical chamber or opening to receive the outer rotor 48 and the inner rotor assembly 34, and defines an axial end wear surface 72 with the thrust plate 56 and an axial end wear surface 74 with the pressure plate 30. The outer rotor 48 and the inner rotor assembly 34 are in rotating engagement, and may be in sealing engagement with the thrust plate 56 at the wear surface 72 where the outer rotor 48 and the inner rotor assembly 34 may otherwise contact with the thrust plate 56. The outer rotor 48 and the inner rotor assembly 34 may be in sealing engagement with the pressure plate 30 at the wear surface 74 where the outer rotor 48 and the inner rotor assembly 34 may otherwise contact with the pressure plate 30.

Rotation of the inner rotor assembly 34 and the outer rotor 48 defines an expanding volume chamber 80 in fluid communication with the fluid inlet port 18, and a contracting volume chamber 82 in fluid communication with the fluid outlet port 20.

Figure 6:
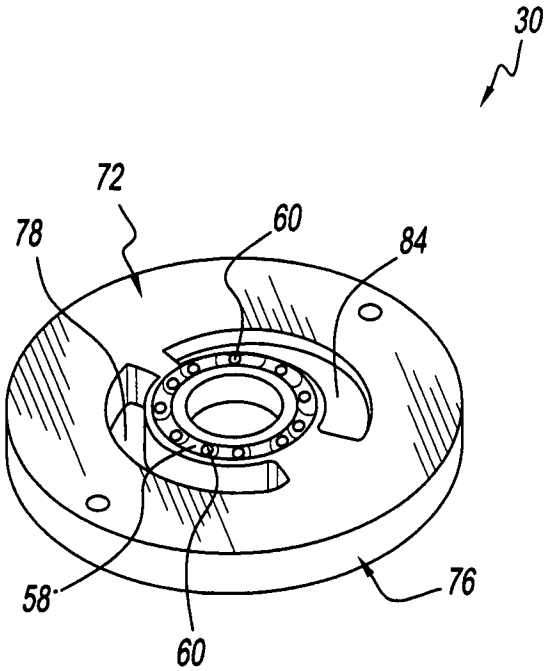
FIG. 6 shows an isometric view of a pressure plate according to the principles of the present invention.

Referring also to FIG. 6, an isometric view of the pressure plate 30 is shown. The pressure plate 30 may have an annular groove 58 on the wear surface 74 of the pressure plate 30. The annular groove 58 defines fluid communication with the plurality of inner openings 64 of the inner rotor body 36. The radius of the annular groove 58 may be comparable to a distance between the inner opening 64 and the rotating axis A2 of the inner rotor body 36 (illustrated in FIG. 4) so that the annular groove 58 is aligned with the inner openings 64. The annular groove 58 may be equipped with a plurality of fluid communication holes (ports) 60 formed or drilled through the opposite side 76 of the pressure plate 30. These fluid communication holes 60 define fluid communication between the outlet chamber 24 and the inner opening 64 to provide fluid pressure to the bottom surface 66 of the vane 42. Pressurized fluid supplied from the inner opening 64 to the annular groove 58 may further be pressurized into a clearance 92 (FIG. 1) between the pressure plate 30 and the rotor set formed by the inner rotor 34 and the outer rotor 48 to provide lubrication between the pressure plate 30 and rotor set, thus prevent galling and gauging and avoid pump damage.

The pressure plate 30 may include an outlet fluid chamber 78 and an inlet port 84. The inlet port 84 of the pressure plate 30 is aligned with the expanding volume chamber 80 in fluid communication with the inlet chamber 22. The outlet fluid chamber 78 is aligned with the contracting volume chamber 82 in fluid communication with the fluid outlet port 20.

Figure 7:
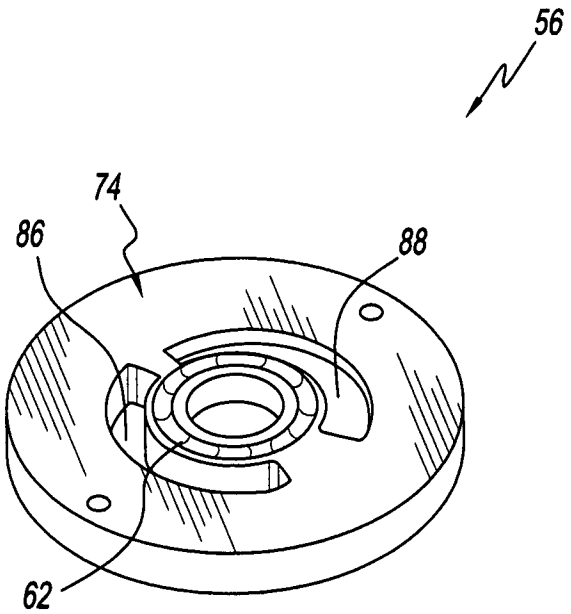
FIG. 7 shows an isometric view of a thrust plate according to the principles of the present invention.

Referring now to FIG. 7, an isometric view of the thrust plate 56 is shown. The thrust plate 56 may include an annular groove 62 on the wear surface 72 of the thrust plate 56. The annular groove 62 defines fluid communication with the plurality of inner openings 64 of the inner rotor body 36. The radius of the annular groove 62 may be comparable to a distance between the inner opening 64 and the rotating axis A2 of the inner rotor body 36 (illustrated in FIG. 4) so that the annular groove 62 is aligned with the inner openings 64. Pressurized fluid supplied from the inner opening 64 to the annular groove 62 may further be pressurized into a clearance 90 (FIG. 1) between the thrust plate 56 and the rotor set formed by the inner rotor 34 and the outer rotor 48 to provide lubrication between the thrust plate 56 and rotor set, thus prevent galling and gauging and avoid pump damage.

The thrust plate 56 may include an inlet fluid chamber 86 and a discharge port 88. The inlet fluid chamber 86 of the thrust plate 56 may be aligned with the expanding volume chamber 80 in fluid communication with the inlet port 18. The discharge port 88 may be aligned with the contracting volume chamber 82 in fluid communication with the outlet port 20.

Figure 8:
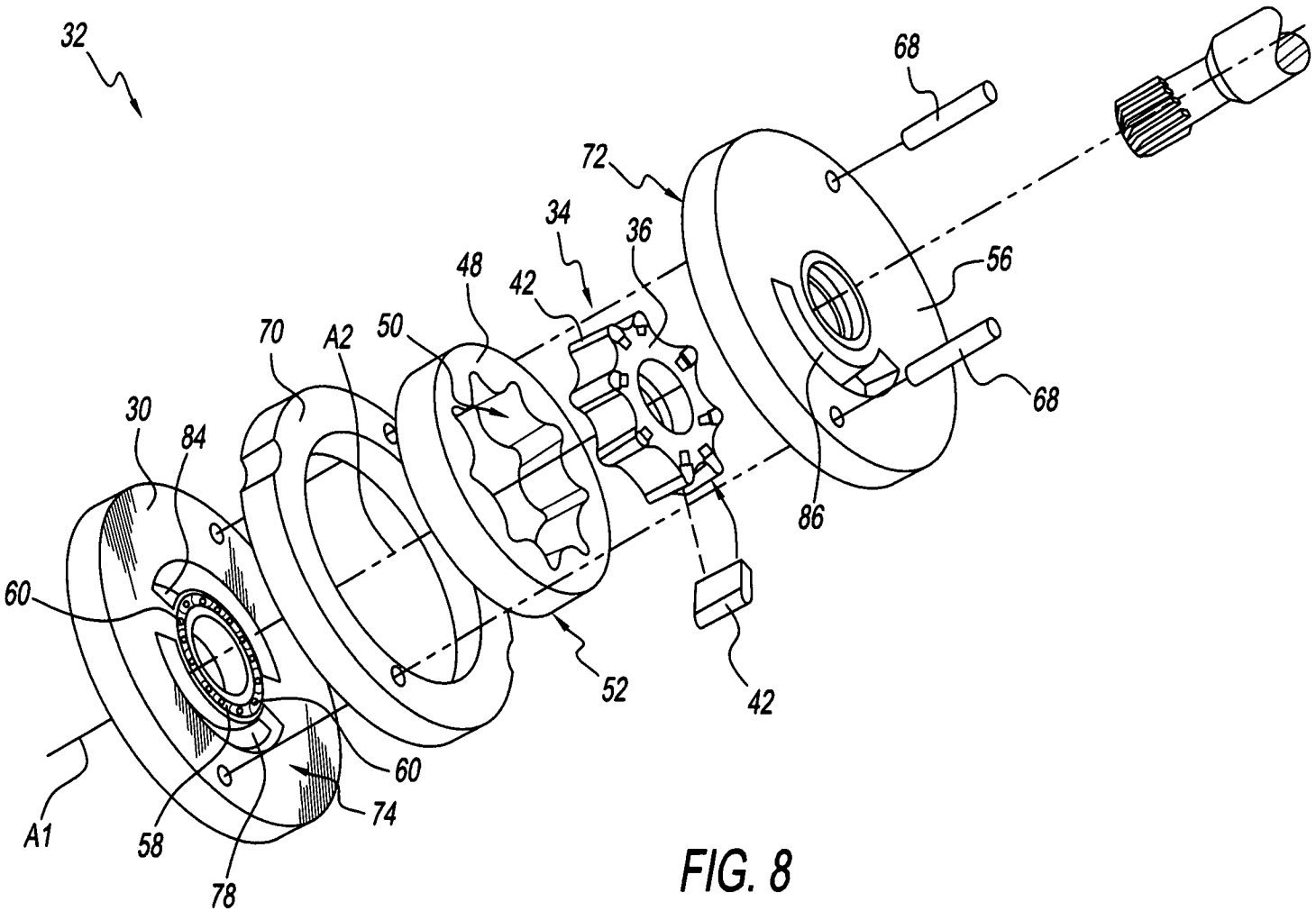
FIG. 8 shows an exploded view of a fluid displacement mechanism according to the principles of the present invention.

Referring now to FIG. 8, a fragmentary, somewhat schematic, exploded view of the fluid displacement mechanism 32 is shown. This figure illustrates the component assembly configuration of the fluid displacement mechanism 32. The schematic illustrates the input shaft 26, two dowel pins 68, the thrust plate 56, the inner rotor assembly 34 with including a plurality of the vanes 42 and its rotating axis A2, the outer rotor 48 and its rotating axis A1, the eccentric ring 70, and pressure plate 30.

Referring now to FIG. 1, the slight clearances 90, 92 between the rotors 34, 48 and the thrust plate 56 and pressure plate 30, respectively allow the outlet fluid in the inner openings 64 to pressurize and lubricate the end surfaces of the inner and outer rotors. This layer of fluid with continuous flow eliminates the galling or gouging (seizure) between the pressure and thrust plates 30, 56 and the inner and outer rotors 34, 48 end surfaces. In effect, the pump or compressor 10 maintains its high volumetric efficiency and high output pressure capability.

The description above is only exemplary for illustration of preferred embodiments. Many alternatives may be made on a gerotor pump without departure from the principles of the disclosure. For example, a fluid flow regulator (flow control valve), a fluid pressure regulator (pressure control valve), an integrated electric motor, or an integrated fluid reservoir may further be combined with a gerotor pump based on the principles of this disclosure for better packaging or precision control applications.

The eccentric ring 70 may also be eliminated by incorporating an eccentric cylindrical opening in the housing member 12 to receive the rotary fluid displacement mechanism and achieve the same result.

This invention can be coupled with and driven by a prime mover such as an electric motor or an engine to perform hydro-mechanical actuation tasks or to provide hydraulic power (pressure) to actuate mechanical systems, or to provide high pressure fluid (oil) to lubricate the components in motion of the machine.

This invention can also be used as a compressor for air conditioner, a hydraulic motor to drive mechanical systems, a pump to deliver oil to lubricate the internal components in motion of the engine, a pump in the automatic transmission to provide hydraulic power to actuate a clutch or dual clutch transmission systems.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A gerotor pump having an outer rotor defining an inner surface of the outer rotor, a thrust plate, a pressure plate, an inlet chamber for fluid intake through the thrust plate to be pressurized, and an outlet chamber for outputting pressurized fluid from the pressure plate, comprising:

an inner rotor assembly in rotating engagement with the outer rotor between a first axial end surface defined by the thrust plate and a second axial end surface defined by the pressure plate, said inner rotor assembly rotating about an axis, said inner rotor assembly comprising:

a rotor body, wherein the rotor body includes N, an integer greater than one, vane slots defining a first sealing surface, and said rotor body includes N inner openings around the axis, each of said inner openings adjoins a respective one of the vane slots, and a plurality of vanes defining a second sealing surface, wherein each of said vanes is disposed in one of the vane slots and in sealing engagement with the rotor body via the first and second sealing surfaces, wherein the inner rotor assembly is in sealing engagement with the outer rotor by each of the vanes engaging on the inner surface of the outer rotor; said gerotor pump further comprising:

said thrust plate defining a first annular groove on the first axial end surface; and said pressure plate defining a second annular groove on the second axial end surface, said second annular groove further comprising a plurality of fluid communication holes in the second annular groove, wherein the radius of any of the first and second annular grooves is located at a distance between one of the inner openings and the axis, and wherein the first annular groove, the second annular groove, the fluid communication holes and the inner openings are in fluid communication.

2. The gerotor pump as in claim 1, wherein each of the inner openings is located between the respective one of the vane slots and the axis, and wherein the respective one of the vane slots is wider than each of the inner openings.

3. The gerotor pump as in claim 2, wherein at least one of the inner openings is in fluid communication with the outlet chamber.

4. The gerotor pump as in claim 2, wherein each of the vanes further comprises a bottom surface that is exposed to one of the inner openings when said each one of the vanes is disposed in the respective one of the vane slots.

5. The gerotor pump as in claim 1, wherein each of the vanes comprises a convex top surface operating as a tooth of the inner rotor assembly.

6. The gerotor pump as in claim 1, wherein each one of the inner openings is located between the respective one of the vane slots and the axis, and adjoins the respective one of the vane slots, and wherein each one of the inner openings is wider than, or as wide as the respective one of the vane slots.

7. The gerotor pump as in claim 6, wherein each one of the vanes further comprises a convex bottom surface that is exposed to one of the inner openings when the vanes are disposed in the rotor body.

8. A gerotor pump having a thrust plate, a pressure plate, an inlet chamber for fluid intake through the thrust plate to be pressurized, and an outlet chamber for outputting pressurized fluid from the pressure plate, comprising:

an outer rotor rotating about a first axis; and an inner rotor comprising a rotor body, said inner rotor rotating about a second axis that is parallel with the first axis, said rotor body defining a plurality of rotor openings around the second axis, and said inner rotor in rotating engagement with the outer rotor, wherein the inner and outer rotors are disposed between, and in sealing engagement with a first axial end surface of the thrust plate and a second axial end surface of the pressure plate, wherein said thrust plate comprises a first annular groove on the first axial end surface; and said pressure plate comprises a second annular groove on the second axial end surface, wherein the second annular groove is further comprises a plurality of fluid communication holes in fluid communication with the first annular groove, the second annular groove, and the rotor openings, and wherein the radius of any of the first and second annular grooves is located at a distance between one of the rotor openings and the second axis.

9. The gerotor pump as in claim 8, wherein the inner rotor further comprises a plurality of vanes, and the rotor body defines a plurality of vane slots, each of the vane slots adjoins and is open to one of the rotor openings, wherein each one of the vanes is disposed in a respective one of the vane slots, and wherein each one of the vane slots is located radially outward from the adjoining one of the rotor openings.

10. The gerotor pump as in claim 9, wherein each one of the vanes comprises a vane head and a vane seat, and wherein the vane head is in sealing engagement with the outer rotor, and the vane seat is exposed to one of the rotor openings.

11. The gerotor pump as in claim 10, wherein the vane head is a cylindrical roller.

12. The gerotor pump as in claim 9, wherein each one of the vanes has a convex top surface and a convex bottom surface, wherein the top surface is in sealing engagement with the outer rotor and the bottom surface is exposed to one of the rotor openings.

* * * * *